United States Patent [19]

Storace et al.

[11] 3,966,193

[45] June 29, 1976

[54] MAIL HANDLING STACKING AND FEEDING APPARATUS

[75] Inventors: Anthony Storace, Tarrytown, N.Y.; Paul R. Sette, Hamden, Conn.

[73] Assignee: Pitney-Bowes, Inc., Stamford, Conn.

[22] Filed: Mar. 12, 1975

[21] Appl. No.: 557,490

[52] U.S. Cl. ..... 271/150; 271/110; 271/126; 271/166

[51] Int. Cl.[2] ..... B65H 1/02; B65H 1/24

[58] Field of Search ..... 271/118, 110, 111, 149, 271/150, 126, 127, 129, 30 A, 166

[56] References Cited

UNITED STATES PATENTS

| | | | |
|---|---|---|---|
| 2,847,213 | 8/1958 | Duncanjon et al. | 271/150 |
| 3,073,460 | 1/1963 | Richert et al. | 271/150 X |
| 3,185,472 | 5/1965 | Rubow | 271/149 X |
| 3,265,384 | 8/1966 | Shute | 271/118 X |
| 3,575,410 | 4/1971 | Suzuki | 271/111 |
| 3,618,933 | 11/1971 | Roggenstein et al. | 271/126 |
| 3,895,790 | 7/1975 | Hoyer et al. | 271/118 X |

OTHER PUBLICATIONS

Rogers, J. C., "Cut Sheet Feed Device", IBM Technical Disclosure Bulletin, vol. 14, no. 5, Oct. 1971, pp. 1534–1535.

*Primary Examiner*—Evon C. Blunk
*Assistant Examiner*—Bruce H. Stoner, Jr.
*Attorney, Agent, or Firm*—William D. Soltow, Jr.; Albert W. Scribner; Robert S. Salzman

[57] ABSTRACT

A stacking and feeding tray is described, which provides a fluctuating urging force upon a stack of mail. The fluctuating urging force provides a proper feeding of pieces of mail, such that a double feed of envelopes is essentially eliminated. The fluctuation in feed-in force is provided by a clutched drive, which is responsive to an optical sensing of the discharge of a piece of mail.

8 Claims, 4 Drawing Figures

MAIL HANDLING STACKING AND FEEDING APPARATUS

The invention pertains to mail-handling apparatus, and more particularly to a stacking and feeding tray for mail-handling systems.

BACKGROUND OF THE INVENTION

In mailing systems of the type described in application No. 476,618 filed June 5, 1974, now U.S. Pat. No. 3,877,531; a reliable feed and stacking apparatus is required, that will insure a proper feeding of individual pieces of mail. Too often, more than one piece of mail will be fed into a mailing apparatus, usually causing a jamming in the transporting of the letters. A double feed of envelopes not only causes jamming, but requires operator attention to separate the doubles and reprocess the mail through the mail system.

An analysis of the problem has shown that doubles often occur as a result of frictional forces between the envelopes. In other words, when one envelope is discharged from the feed deck, an adjacent envelope is often pulled along with this envelope, by virtue of the friction existing between these contiguous pieces of mail.

The present inventive feed-in stacking apparatus is designed to reduce the probabilities of incurring a double feed.

Another problem common to feed-in stacking devices, is the maintenance of a constant magnitude of feed force despite the size of the stack. The present invention has means for providing a substantially constant feed force magnitude upon the stack of mail regardless of the stack size.

SUMMARY OF THE INVENTION

The invention is for a stacking and feed apparatus for mail-handling systems. Letters are stacked upon a tray in edgewise fashion, i.e., standing upon their edge. A guide wall of the tray acts to align the envelopes and provides a uniform stack, by registratively guiding the leading edge of each envelope as it moves along the feed-in tray.

A pressure plate is slidably mounted upon the tray and acts to intermittently compress the stack of mail. The pressure exerted upon the stack, causes the leading envelope of the stack to come into frictional engagement with a discharge roller. The leading envelope is then fed to the bite of a pair of separating rollers, and is subsequently pulled from the stack. As the leading edge of the envelope approaches the separating rollers, a photosensing device is tripped, which actuates a clutch on the drive of the pressure plate. This causes the pressure plate to cease its force against the stack. This in turn reduces the frictional force between the discharging piece of mail, and its adjacent piece of mail, thus causing the discharging piece of mail to move freely from the stack.

The easing of the frictional force between the discharging letter and an adjacent envelope reduces the chances of a double feed.

As the letter is finally discharged by the separator, the trailing edge of the envelope moves past the optical sensor, which causes the clutch on the pressure plate drive to deactuate. The next envelope is now urged against the discharge roller to complete the feed-in cycle.

During the discharge of an envelope, the discharge roller is also deactivated by the photosensor, so that as the envelope passes, the adjacent envelope receives no discharging force. The discharge roller is subsequently reactivated by the photosensing unit when the trailing edge of the envelope moves past. The drive of the discharge roller is also controlled through a clutch, which is controlled by said optical sensor.

A constant magnitude of force is developed by the pressure plate upon the stack of mail despite the size of the stack. In other words, a constant frictional discharging force is maintained as the size of the stack diminishes, because the normal force exerted by the pressure plate and the letters upon the discharging roller is maintained at a given level. The pressure plate exerts a constant force by means of frictionl belt drive and mechanical slip clutch arrangement. The pressure plate is urged against the stack of mail by means of a moving belt which is frictionally engaged to the plate. A slip clutch disposeed between the belt and the belt drive is adjusted to slip when the belt force reaches a desired magnitude.

It is an object of this invention to provide an improved stacking and feeding apparatus for mail-handling systems;

It is another object of the invention to provide a feed-in device for mail-handling machines, which will reduce the probabilities of feeding a double piece of mail; and It is still another object of this invention to provide a stacking and feeding apparatus for pieces of mail which will produce an intermittent force upon the stack of mail, which force will be of a given magnitude despite the size of the stack.

These and other objects of the invention will be better understood and will become more apparent with reference to the following detailed description, taken in conjunction with the attached drawings in which.

Detailed Description of the Invention

Generally speaking, the invention is for a mail-handling stacking device for supporting a quantity of mail, and for urging this mail towards a discharging device. The apparatus of this invention comprises support means for supporting the quantity of mail and a pressure means carried by the support means. The pressure means urges the mail towards a discharging mechanism. A drive means drives the pressure means into engagement with the mail, and a clutch causes an interruption in this drive. A sensing means disposed adjacent the discharging mechanism senses the discharging of pieces of mail. The sensing means actuates and deactuates the clutch in response to the discharging of the pieces of mail. The alternating actuation and deactuation of the clutch causes the driving means and the pressure means to operatively fluctuate. Thus, the pressure means is caused to fluctuate between a mail urging and a mail nonurging position.

The pressure means in addition to providing a fluctuation in the urging of the mail, also provides a force of substantially constant magnitude upon the mail irrespective of the quantity of mail in the stack.

Figure 1:
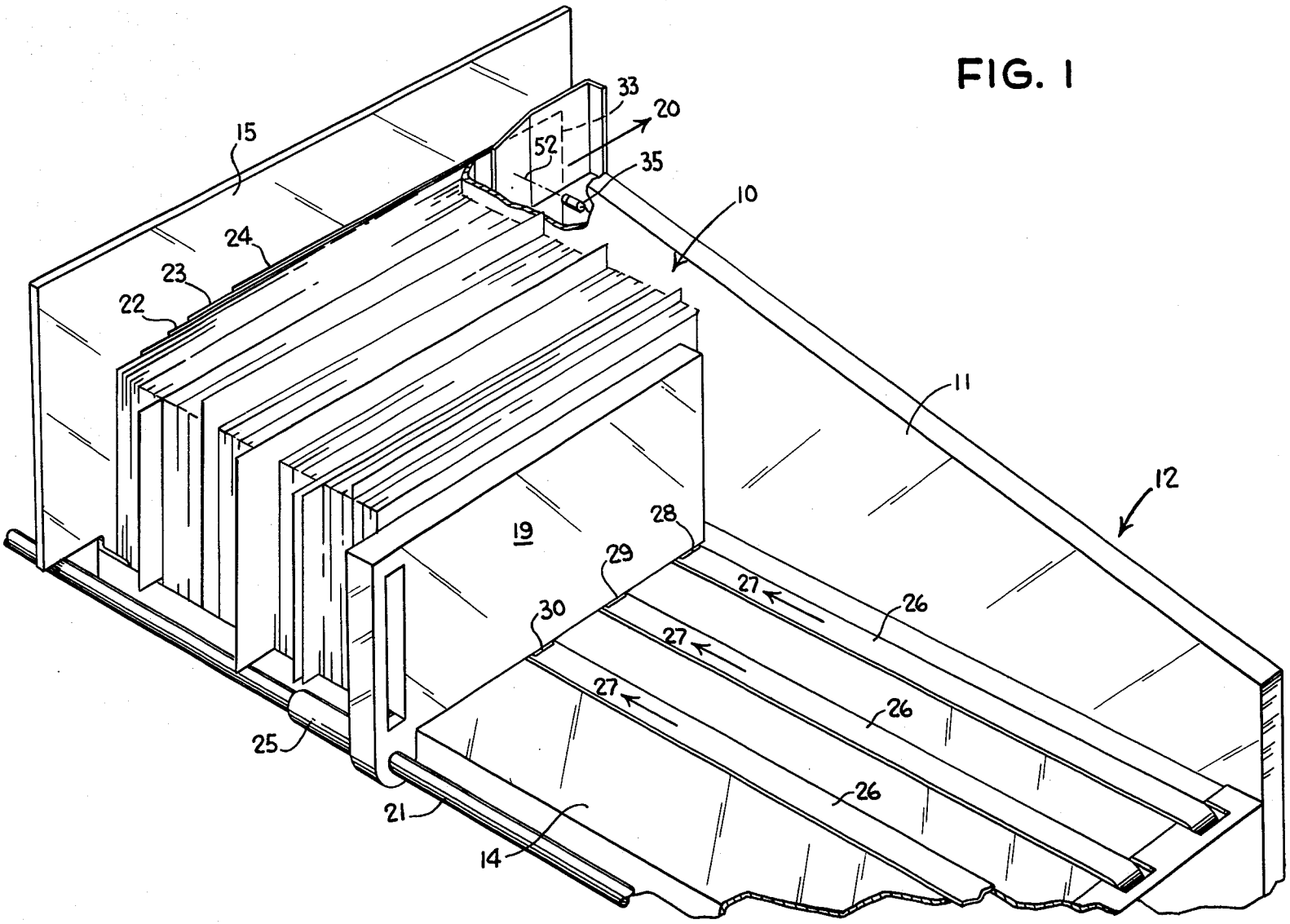
FIG. 1 is a perspective view of a quantity of mail disposed upon a tray of the mail-handling apparatus of this invention.

Now referring to FIG. 1, a stack of mail is generally shown by arrow 10. The stack 10 comprises a large quantity of mixed and/or uniformly sized mail. All of the pieces of mail are individually standing on their edge as shown, and are evenly stacked against wall 11 of the supporting tray depicted generally by arrow 12.

The tray 12 comprises a platform 14 upon which the letters receive their primary support. The aformentioned guide wall 11 keeps the ends of the letters in aligned registration. A back wall 15 of tray 12 forms with roller pairs 16, 17 and 18, respectively (FIG. 2) a discharging surface for the pieces of mail coming in contact therewith.

Individual pieces of mail are discharged in seriatim (one behind another) from tray 12 in the general direction of arrow 20. A pressure plate 19 forces the entire stack towards back plate 15, where the rearmost letters 22, 23, 24, etc. are shingled (peeled off) from the stack 10 by means of roller pair 17 as illustrated.

The pressure plate 19 is slidably mounted upon shaft 21 by means of a ball bushing 25. This allows the plate 19 to move freely over platform 14.

A plurality of continuously formed belts 26 are caused to be driven over platform 14 towards the back plate 15 as shown by arrows 27. Pads 28, 29 and 30 attached to the bottom of plate 19 frictionally engage each of the respective belts 26 causing plate 19 to exert a force upon stack 10 in direction 27 (towards the back plate 15).

Figure 2:
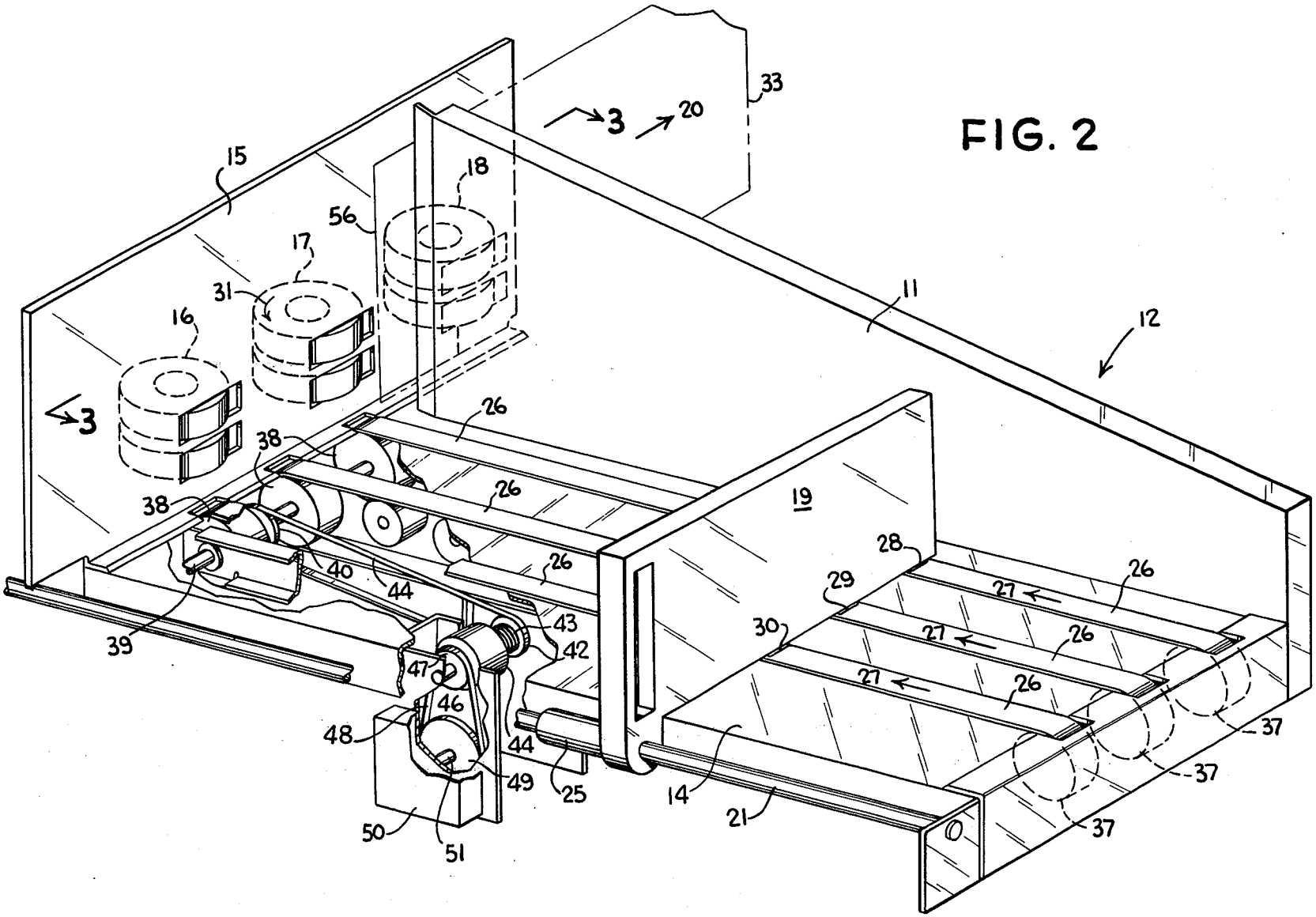
FIG. 2 is a cutaway internal perspective view of the mail-handling apparatus of the invention of FIG. 1.
Figure 4:
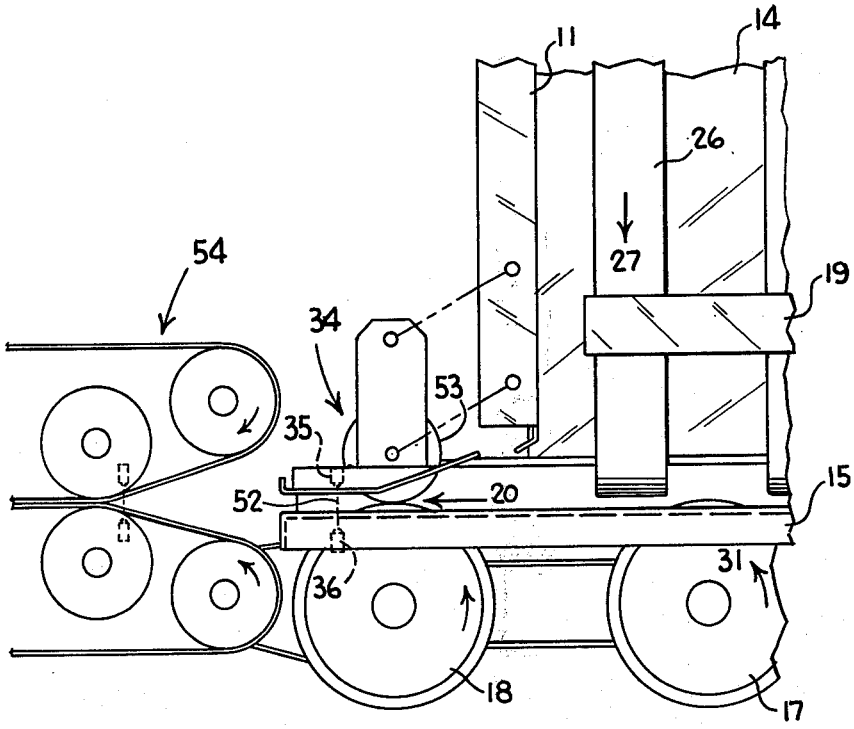
FIG. 4 is a top view of the mail-handling apparatus of FIG. 3, taken along lines 4—4.

The roller pair 17 is caused to rotate in direction 31 as shown in FIGS. 2 and 4. This causes the aforementioned shingling of the mail, and eventually one letter will be fed (arrow 20, FIGS. 1, 2 and 4) to the bite of a separator shown generally by arrow 34.

An optical sensor comprising a phototransistor 35 and an LED 36 (FIG. 4) determine when a letter is fed to the bite of separator 34, by sensing its leading edge. Once a letter is within the separator 34, it becomes desirable, in accordance with this invention, to cease the pressure upon the stack 10 (FIG. 1). This greatly reduces the friction between the shingled letters, and prevents the feeding of doubles.

Referring to FIG. 2, each of the belts 26 are supported for rotation between two rollers 37 and 38, respectively. Rollers 38 are supported upon shaft 39, which is rotatively driven by means of a pulley 40 that is affixed to shaft 39. The pulley 40 is powered by a belt 41, which wraps about a driving pulley 42. The driving pulley 42 is rotatively secured to a shaft 46 supporting a mechanical and electrical clutch combination 43 and 44, respectively. The mechanical clutch 43 is a slip-type clutch, and is operative only when the electrical clutch is engaged. The shaft 46 is fixed to pulley 47 and driven by belt 48. Belt 48 is powered by pulley 49, which is connected to electrical motor 50 via shaft 51.

Operation of the Invention

Referring to FIGS. 1 and 2, a stack of mail 10 is registratively aligned against wall 11 of the stacking tray 12. The motor 50 (FIG. 2) operatively drives belts 26, which in turn causes pressure plate 19 to urge the stack of mail towards the discharging roller pair 17. The pressure plate 19 pushes against the stack 10, until such time as the compressive resistance or counter force of the stack of mail causes the mechanical slip clutch 43 to begin to slip. By adjusting the spring tension on the mechanical slip clutch, the force exerted by the pressure plate 19 can be varied as desired, or as found to be operatively required for proper discharging of the pieces of mail. The force of the pressure plate will remain constant despite the size of the stack of mail, because this force will always be equal to the resistive compressive force of the stack. The resistive stack force will in turn remain constant and equal to the force required to cause slippage in mechanical clutch 43.

Thus, despite the initial size of the stack, or the size of the stack as it is caused to be diminished by the discharging of pieces of mail, the force of the pressure plate 19 will always be of constant magnitude.

As the stack 10 is compressed by the force of the pressure plate 19, a shingling of pieces of mail occurs as illustrated by letters 22, 23 and 24 of FIG. 1. This is caused by the frictional engagement of the last letter 24 in the stack 10 with roller pair 17. The other letter 23, begins to peel off also, as a result of its frictional engagement with letter 24. Letter 23 starts to likewise shingle as a consequence of its frictional engagement with letter 23, and so on. Roller pair 16 is a free wheeling pair of rollers, that is placed upon back plate 15 to add support to the letter stack, and to reduce the frictional drag of the letter ends upon plate 15.

As the lead envelope 24 breaks away from the stack 10 (arrow 20, FIGS. 1 and 4) its leading edge 33 becomes caught in the bite of the rollers 18 and 53 of separator 34 (FIG. 4). The separator 34 then causes the envelope 24 to be moved toward the mail transporting device shown generally by aroow 54 in FIG. 4. The phototransistor 35 and LED 36 are positioned adjacent the separator rollers, and the light path 52 is broken by the leading edge 33 of envelope 24.

Figure 3:
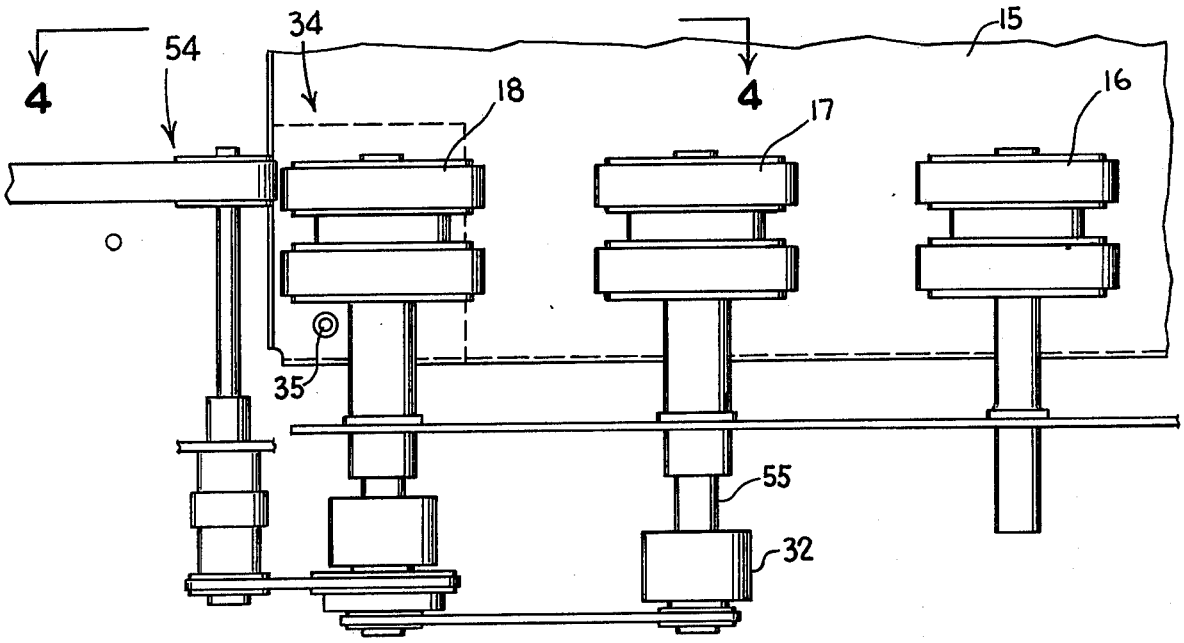
FIG. 3 is a back view of the mail-handling apparatus of FIG. 2, taken along lines 3—3.

When the light path 52 is interrupted, an actuating signal is given to the belt drive electrical clutch 44, and an electrical discharge roller clutch 32 (FIG. 3) disposed on the drive shaft 55 of the discharge pair of rollers 17. This results in the cessation of the force exerted by the pressure plate, and the rotation of the discharge pair of rollers 17. This will prevent the next letter 23 from moving along with letter 24 to the transport device 54, hence eliminating doubling (two envelopes being transported at the same time).

Cessation of the discharge roller pair from rotating will naturally prevent a desired feeding of the next letter 23 to the bite of separator 34. In addition, the cessation of the force exerted by pressure plate 19 will prevent frictional engagement between letters 23 and 24, such that there will not be a tendency for letter 23 to frictionally stick to letter 24. In other words, letter 23 will be prevented from being dragged along with discharging letter 24.

When the trailing edge 56 (FIG. 2) of the envelope passes the phototransistor 35 and LED 36 (FIG. 4), the light path 52 will then become reinstated. The electrical clutches 44 and 32 will then receive a deactuating signal, and the belt drive and discharge roller pair will once again become operative. This will cause the subsequent letter 23 to be discharged in like fashion to letter 24.

When letter 23 becomes discharged to the transport device 54, the phototransistor 35 will again, operate to actuate and deactuate clutches 44 and 32 to prevent the doubling of letter 23 with the subsequent letter 22, and so on.

The alternating of the belt drive between actuation and deactuation will cause a fluctuating movement in pressure plate 19. This results from the fact, that once pressure is relieved to the stack 10 by plate 19, the envelopes in the stack will decompress and cause plate 19 to move slightly backward (opposite to direction 27; FIG. 1). Thus, the pressure plate 19 will be seen to move in an alternating or jogging manner with respect to the envelope stack.

Many modifications and changes of an obvious nature will likely occur to the skilled practitioner in this art. Therefore, it is seemed that such changes or modifications be encompassed by the invention, and the inventive spirit and scope be interpreted with respect to the following appended claims.

What is claimed is:

1. A mail-handling stacking device for supporting a quantity of mail, and for uniformly urging said quantity of mail irrespective of its size, towards a discharging mechanism in a fluctuating manner, comprising:

support means for supporting a quantity of mail;

pressure means carried by said support means for urging said quantity of mail towards a discharging mechanism;

drive means operatively connected to said pressure means for driving said pressure means into operative engagement with a quantity of mail supported by said support means;

clutch means comprising a dual clutch mechanism, a first clutch of which is operatively connected to said drive means for causing said drive means to be coupled and decoupled from driving said pressure means, and a second clutch of which is a slip clutch operatively connected to said drive means for causing said drive means to drive said pressure plate with a constant force when said first clutch is not decoupling said drive means; and sensing means disposed adjacent said discharging mechanism for sensing the discharging of pieces of mail, said sensing means being operative to descouple said pressure means from said drive means via said first clutch in response to sensing a discharging piece of mail, and to couple said pressure means to said drive means via said first clutch when no discharging piece of mail is sensed such that said pressure means will be caused to fluctuate between a mail urging and a mail non-urging condition.

2. The mail-handling stacking mechanism of claim 1, wherein said support means comprises a mail loading tray for supporting a quantity of envelopes, each stacked upon their edge.

3. The mail-handling stacking mechanism of claim 1, wherein the pressure means comprises a plate that is slidably mounted upon said support means.

4. The mail-handling stacking mechanism of claim 1, wherein said support means comprises a tray for supporting a quantity of mail, said tray supporting at least one friction belt operatively connected to aid drive means and which is intermittently movable upon said tray, and wherein said pressure means comprises a plate that is slidably mounted upon said tray and which is in frictional engagement with said intermittently movable belt.

5. The mail-handling stacking mechanism of claim 1, wherein said support means comprises a tray having a guide wall for guiding stacked pieces of mail and providing a registration between said pieces of mail, and a back plate, and wherein said discharge mechanism comprises a rotatively driven friction roller which is mounted upon said back plate.

6. The mail-handling stacking mechanism of claim 1, wherein said discharging mechanism is intermittently driven by means of a discharge drive means and a discharge clutch operatively connected to said discharge drive means.

7. The mail-handling stacking mechanism of claim 1, wherein said sensing means comprises a light source and a photodetector, a leading edge of a discharging piece of mail breaking a light path between said light source and said photodetector, whereby a first clutch controlling signal is provided, and when discharged, a trailing edge of said piece of mail re-making the light path between said light source and photodetector to provide another first clutch controlling signal.

8. The mail-handling stacking device of claim 1, wherein said support means comprises a tray having a guide wall for aligning pieces of mail in feed-in registry, each of said pieces of mail being supported by said tray on an edge thereof.

* * * * *

UNITED STATES PATENT OFFICE

CERTIFICATE OF CORRECTION

Patent No. 3966193 Dated June 29, 1976

Inventor(s) Anthony Storace and Paul R. Sette

It is certified that error appears in the above-identified patent and that said Letters Patent are hereby corrected as shown below:

Column 5, Claim 1, lines 43 and 44, change "descouple" to --decouple--.

Column 6, Claim 4, line 14, change "aid" to --said--.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*